US009051168B2

(12) United States Patent
Lykov

(10) Patent No.: US 9,051,168 B2
(45) Date of Patent: Jun. 9, 2015

(54) METHOD AND APPARATUS FOR LIFTING OF A MASS OF WATER

(71) Applicant: WATERBOX OY, Lahti (FI)

(72) Inventor: Evgeny Lykov, Metsakyla (FI)

(73) Assignee: WATERBOX OY, Lahti (FI)

( * ) Notice: Subject to any disclaimer, the term of this patent is extended or adjusted under 35 U.S.C. 154(b) by 0 days.

(21) Appl. No.: 13/904,466

(22) Filed: May 29, 2013

(65) Prior Publication Data

US 2013/0319533 A1 Dec. 5, 2013

(30) Foreign Application Priority Data

Jun. 4, 2012 (WO) ..... PCT/FI2012/005047

(51) Int. Cl.

| | |
|---|---|
| ***E02D 23/02*** | (2006.01) |
| ***B67D 99/00*** | (2010.01) |
| ***B63B 25/08*** | (2006.01) |
| ***B63B 35/28*** | (2006.01) |

(52) U.S. Cl.

CPC ..... *B67D 99/00* (2013.01); *E02D 23/02* (2013.01); *B63B 25/08* (2013.01); *B63B 35/28* (2013.01); *B63B 2207/02* (2013.01)

(58) Field of Classification Search

CPC ..... E02D 23/02; B65D 88/78
USPC ..... 405/8, 9, 10, 210; 114/256
See application file for complete search history.

(56) References Cited

U.S. PATENT DOCUMENTS

| | | | | | |
|---|---|---|---|---|---|
| 34,426 | A | * | 2/1862 | Howard | 405/210 |
| 2,050,727 | A | * | 8/1936 | Misz | 405/206 |
| 3,385,464 | A | * | 5/1968 | Courbon | 405/210 |
| T875,008 | I4 | * | 6/1970 | Hnot | 405/210 |
| 3,552,131 | A | * | 1/1971 | Mott | 405/210 |
| 3,710,582 | A | * | 1/1973 | Hills et al. | 405/210 |
| 3,779,193 | A | * | 12/1973 | Hirata | 114/256 |
| 3,889,476 | A | * | 6/1975 | Gerin | 405/210 |
| 3,961,488 | A | * | 6/1976 | Ovsttun | 405/210 |

(Continued)

FOREIGN PATENT DOCUMENTS

| | | |
|---|---|---|
| GB | 1 118 138 A | 6/1968 |
| GB | 1 507 524 A | 4/1978 |
| TW | M342030 | 10/2008 |

OTHER PUBLICATIONS

Written Opinion, dated Dec. 10, 2013, from corresponding PCT application.

(Continued)

*Primary Examiner* — Frederick L Lagman
(74) *Attorney, Agent, or Firm* — Young & Thompson

(57) ABSTRACT

A method and an apparatus for lifting a mass of water with a container from a larger body of water, in which method the container having at least one open opening is first located below the surface level of the larger body of water and the container is full of water, wherein the container is raised partially above the surface level of the water by elements attached to the container, and that the at least one open opening of the container is located below the surface level of the larger body of water during and after raising of the container thus lifting the mass of water located inside the raised portion of container above the surface level of the larger body of water.

16 Claims, 1 Drawing Sheet

(56) References Cited

U.S. PATENT DOCUMENTS

| | | | | |
|---|---|---|---|---|
| 4,047,390 | A * | 9/1977 | Boyce, II | 405/210 |
| 4,335,977 | A * | 6/1982 | Ihli | 405/210 |
| 4,433,940 | A * | 2/1984 | Harrison | 405/210 |
| 4,643,612 | A * | 2/1987 | Bergeron | 405/210 |
| 4,735,524 | A * | 4/1988 | Dunkers | 405/210 |
| 6,491,473 | B2 * | 12/2002 | Veazey | 405/16 |
| 2006/0083492 | A1 | 4/2006 | Barz | |

OTHER PUBLICATIONS

International Search Report, dated Jan. 2, 2013, from corresponding PCT application.

Translation of TW Office Action dated Dec. 18, 2014, from corresponding TW application.

* cited by examiner

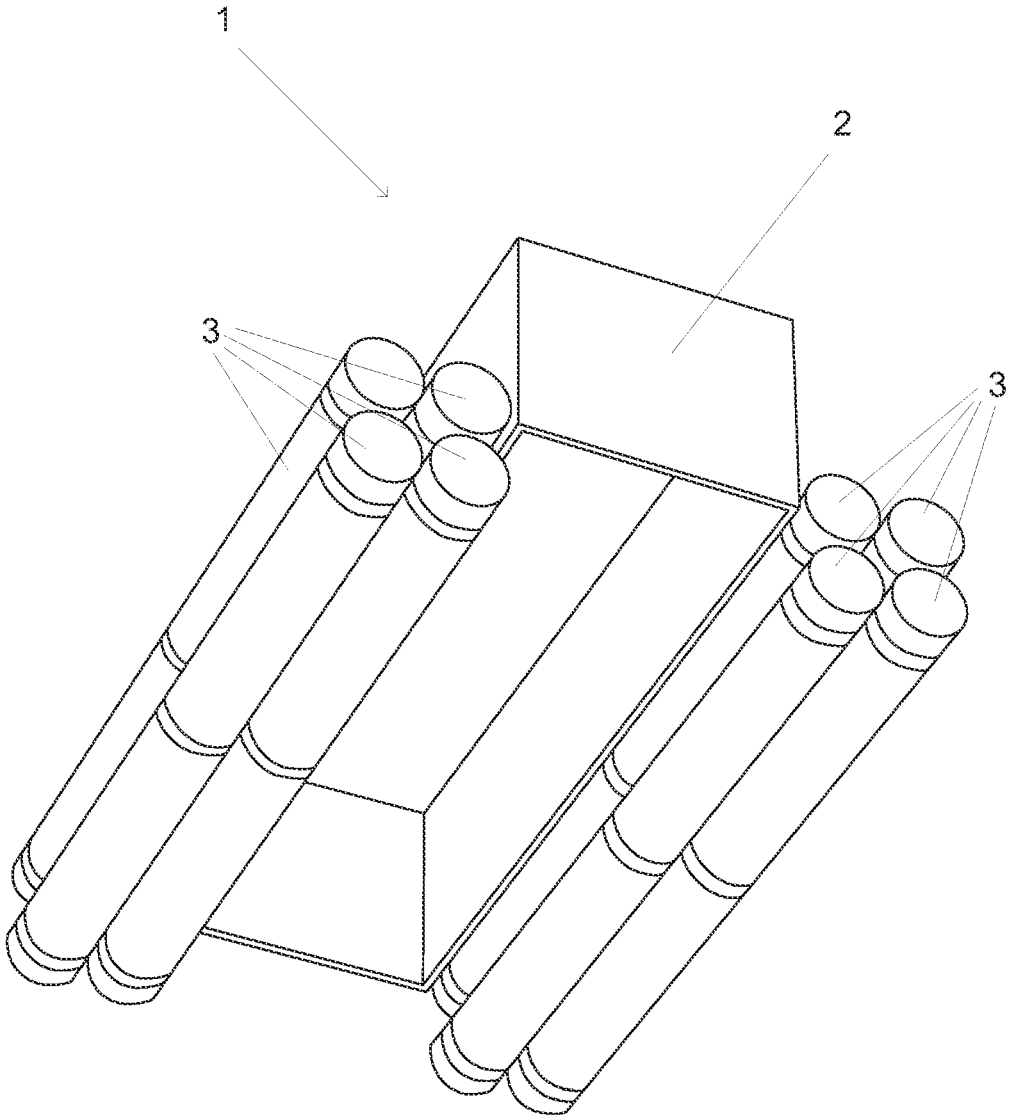
1
2
3
3

METHOD AND APPARATUS FOR LIFTING OF A MASS OF WATER

FIELD OF THE INVENTION

The present invention relates to lifting of a mass of water from a larger body of water, such as a lake or sea or ocean for example. More precisely the invention relates to a method and an apparatus, in which container is used for the lifting.

BACKGROUND OF THE INVENTION

Different types of solutions for moving or transferring water from larger body or reservoir of water for different purposes are known. Generally these solutions use different types of pipes, pumps and/or containers in the transferring process.

SUMMARY OF THE INVENTION

The present invention provides a method and an apparatus for lifting a mass of water from a larger body of water, such as a lake or sea or ocean etc., above the surface level of the larger body of water. In the solution according to the present invention a container having at least one open opening is used for lifting the water, which container is first located under the surface of the larger body of water. When the container is located within the larger body of water, the container is also full of or filled with water, which water can enter inside the container for example through the open opening in the container. The container is positioned within water so that the at least one open opening is substantially at the lower portion of the container, such as in the bottom surface of the container, for example.

The container is equipped with suitable means for lifting the container partially above the surface level of the larger body of water. These means are advantageously pontoons or floats attached to the container, and which are inflatable of fillable with suitable gas in order to achieve the required lifting effect for the container.

During and after the lifting or raising of the container partially above the surface level of the larger body of water, the at least one opening, or all open openings, of the container remain below the surface level of the larger body of water. In this way the water within the container remains inside the whole container, including the portion located above the surface level of the larger body of water.

After lifting the mass of water located within the portion of container raised above the surface level of the larger body of water, the lifted water, or the energy contained within the lifted water, is then usable for suitable purposes.

In this context the top, bottom and side surfaces of the container are defined in relation to the direction of gravity. Also, the larger body of water may be any body of water having volume and dimensions large enough for total immersion of at least the container, and advantageously also the lifting means attached to the container.

The container used in the present invention must be airtight container, except for the area of the at least opening, or openings, and the open opening or openings must remain below surface level of the larger body of water in order to keep the lifted mass of water inside the portion of the container lifted above surface level.

In an advantageous embodiment of the invention the container is advantageously formed of several pieces, which pieces are assembled to form the container. This assembling can be carried out in water, for example around an object to be lifted from bottom of the larger body of water. This type of assembled container can also be disassembled for transporting, for example with suitable ISO container or the like, to different locations.

In an advantageous embodiment of the invention the portion of the water-filled container located above the surface level of the larger body of water when in lifted position is over half of the total volume of the container, which total volume is defined by the outer dimensions and/or outer surfaces of the container.

In an advantageous embodiment of the invention the container has level side, top and end surfaces, and the at least one opening covers substantially the entire bottom surface of the partially raised container.

In an advantageous embodiment of the invention the interior of the container may be divided to separate sections with suitable airtight partition walls. In this way the suitable amount of water to be lifted, and/or to be discharged from partially lifted container, may be adjusted.

In an advantageous embodiment of the invention at least the container is made of plastic, preferably of polypropylene.

In an advantageous embodiment of the invention, especially in such embodiments where the at least opening is located in a level or substantially level bottom surface of the container, under the container can be set a base plate or similar part, which partially or totally covers the at least one opening of the container. With this kind of embodiment it is possible to prevent the water mass located inside the container, or other liquid material inside the container and the water mass, to get significantly mixed with surrounding water during and/or after lifting of the container, for example. The base plate or part can also be used for example to keep or secure materials or items to be lifted on surface inside the container and in the water mass located there. It is to be noted however, that in the present invention the base plate or part will not close the at least one opening water-tightly, in other words the water within the container can flow out of the container even when the whole opening is covered with the base plate or part.

Features defining a method according to the present invention are more precisely presented in claim 1, and features defining an apparatus according to the present invention are more precisely presented in claim 7. Other advantageous embodiments and features are disclosed in dependent claims.

BRIEF DESCRIPTION OF THE DRAWINGS

The exemplifying embodiment of the invention and its advantages are explained in greater detail below in the sense of example and with reference to accompanying drawing, which:

FIG. 1 shows a schematic view of an apparatus according to an embodiment of the invention.

DETAILED DESCRIPTION OF THE INVENTION

FIG. 1 shows a schematic view of an apparatus 1 according to an advantageous, exemplifying embodiment of the invention. The apparatus 1 comprises container 2 and eight pontoons 3 attached to the container.

The container 2 is in this embodiment a hollow rectangular prism or cuboid shaped container where opposite sides of the container are parallel, having an opening in the bottom surface of the container, the opening substantially covering the whole of the bottom surface of the container. In other words, the bottom surface of the container 2 is open. Through this opening water has access to the interior of the hollow container 2, when container is submerged within larger body of water.

The pontoons 3 are arranged in two groups of four pontoons. The pontoons 3 have circular cross-section through their length and level end surfaces, and have substantially same length as the container 2 has. The pontoons 3 are located in relation to the container 2 so, that the end surfaces of the pontoons are substantially in the same plane as the end surfaces of the container.

The grouping of pontoons 3 is formed so that two pontoons are located side by side, and another two pontoons are located below the first pair of pontoons. In the grouping each pontoon 3 is fastened at least to two adjacent pontoons in order to form a square-type of arrangement of pontoons in the group.

The group of pontoons 3 is fastened to the side surface of the container 2 so, that the one of the first pair of pontoons is fastened in the container 2, and the second pair of pontoons within the group is located below the bottom surface of the container.

When the apparatus 1 is used, the container 2 is first submerged in a suitable larger body of water in such a way that the inside of the container is filled with water when the container is fully submerged. In order to remove all air from the container 2 during the submerging process the container may be submerged sideways, or alternatively the container may be provided with closable openings located in the upper surface of the container, that are opened for submerging of the container and closed once all air has escaped from the inside of the container.

Alternatively, the container 2 may be advantageously formed of separate pieces, for example separate level wall sections or elements, which are connected to adjacent pieces with airtight connections to form the container. In this embodiment the container may be assembled within the larger body of water and thus the container is already filled with water once the container is assembled.

Once the container is submerged and the inside of the container 2 is full of water, the pontoons 3 attached to the container are filled with air or other suitable gas in order to create lifting effect to the submerged container. The groups of pontoons 3 may be attached to the container 2 prior, during or after the container is submerged in the larger body or water.

When the pontoons 3 are filled, the pontoons raise the container 2 partially above the surface level of the larger body of water. In the raised position, the part of the container 2 which is above the surface level of the larger body of water remains filled with water as long as air does not have access to the inner portion of the raised container. Thus the opening covering the bottom surface of the container 2 needs to remain under water during and after the lifting of the container partially above the surface level of the larger body of water.

The dimensions of the container 2 and the pontoons 3 can be defined based on Archimedes' principle with the following equation:

$$V_p=(\rho_c/\rho_w-a)l_xl_yl_z+(1-\rho_c/\rho_w)(l_x-2t)(l_y-2t)(l_z-t)$$

where $V_p$ is volume of the pontoons, $\rho_c$ is density of the container material, $\rho_w$ is density of water, a is the portion of container that remains below the surface of the larger body of water (in percentage), $l_x$, $l_y$, $l_z$ are linear dimensions of the container, and t is thickness of the wall of the container.

In the In the exemplary embodiment of FIG. 1 the rectangular cuboid shaped container 2 has length of 15 m ($=l_x$), width of 5 m ($=l_y$) and height of 4 m ($=l_z$). The container 2 is manufactured with polypropylene, which is suitable plastic for a container according to the present invention, having density of about 910 kg/m$^3$ ($=\rho_c$), and suitable wall thickness of the container is 10 cm (=t). Water density is generally about 1000 kg/m$^3$ ($=\rho_w$).

Further, in order to prevent the lower edge of the container 2 raising above the surface level of the larger body of water due to waves for example, the distance from the bottom surface of the container to the water surface is set to be 1.2 m. Based on this distance, the variable a can be defined as: a=1.2 m/4 m.

Now, based on the above dimensions of the container 2 and the above equation, it can be derived, that by using four pontoons 3 in a group on both sides of the container, the pontoons having the same length as the container (=15 m) and diameter of 1.5 m for each pontoon, the container 2 full of water can be raised partially above the surface level of the larger body of water so that the surface level of the larger body of water will be set on the defined 1.2 m from the bottom of the container. In the raised position, when the raised portion of container 1 is filled with water, the pontoons 3 remain under the surface level of the larger body of water. Advantageously, the fixing point for the group of pontoons in the longer side surface of the container will be about 25 cm from the bottom surface.

In the solution according to the present invention the interior of container 2 may be divided two or more sections with suitable airtight partition walls. In this way the amount or mass of water to be lifted can be adjusted. However, in the cases where a smaller amount of water is to be lifted, the filling of pontoons 3 with suitable gas must also be compensated accordingly in order to prevent the bottom surface of the container 2 or its edge rising above the surface level of the larger body of water.

Further, it is evident for a person skilled in the art that the size and shape of the container 2 and thus the amount of water lifted or raised can be changed as long as the size of pontoons 3 is changed in correlation based on the Archimedes' principle.

It is also to be noted, that the size of pontoons 3 that lifts the water filled container 2 partially above the surface of the larger body of water and keeps it in that lifted position can also lift water filled container from greater depths of water, since the buoyancy created by the pontoons in greater depths of water is increased due to the increased density of water. Thus use of the apparatus 1 accordance to the present invention is not affected by the depth of water from which the container 2 is lifted or raised, as long as the pontoons 3 and container can survive the pressure exerted on them by increased water pressure.

The opening of the container 2, when the container is filled with water, can be covered partially or totally by a suitable base plate or part, which for example restricts the possibility of water located within the container to get significantly mixed with surrounding water during and/or after lifting of the container. This kind of base plate or part can also be used to secure materials or items within the container 2 during and after lifting of the container, for example to guarantee the water environment for the object to be lifted. This base plate or part however will not secure the opening of the container 2 water-tightly.

The specific example provided in the description given above should not be construed as limiting. It is evident to a person skilled in the art that the container can be made of any shape and sizes and of any suitable material. Further, suitable lifting means for the container are not limited to pontoons or floats, but any other suitable means may also be used. Therefore, the invention is not limited merely to the embodiment described above.

The invention claimed is:

1. A method for lifting a mass of water with a container from a larger body of water, in which method the container having at least one open opening is first located below the surface level of the larger body of water and the container is full of water, wherein the container is raised partially above the surface level of the water by means attached to the container, and that the at least one open opening of the container is located below the surface level of the larger body of water during and after raising of the container thus lifting the mass of water located inside the raised portion of container above the surface level of the larger body of water, wherein the means attached to container for lifting the container comprise pontoons and/or floats which are inflated or filled with gas in order to raise the container.

2. A method according to claim 1, wherein the container is formed of several pieces, which pieces are assembled to form the container outside of the larger body of water.

3. A method according to claim 1, wherein the container has level side, top and end surfaces, and the at least one open opening covers substantially the entire bottom surface of the partially raised container.

4. A method according to claim 1, wherein the container is formed of several pieces, which pieces are assembled to form the container within the larger body of water.

5. The method of claim 1, wherein the pontoons are arranged in two groups attached on opposite sides of the container along a length of the container, each group of the pontoons having a length substantially equal to the length as the container and with end surfaces of the pontoons substantially in a same plane as end surfaces of the container.

6. The method of claim 5, wherein the pontoons are located below the bottom surface of the container during the raising of the container.

7. The method of claim 1, wherein filling the container with the water includes removing all air from the interior of the container.

8. An apparatus for lifting a mass of water, the apparatus comprising a container for lifting the mass of water after the container is placed below the surface level of a larger body of water and filled with the water, the container comprising at least one open opening, and pontoons for lifting the container filled with water, wherein, the pontoons are attached to the container for raising the container partially above the surface level of the larger body of water, the at least one open opening is located in the container so that the least one open opening remains located below the surface level of the larger body of water when the container is raised partially above the surface level of the larger body of water, and the pontoons attached to the container are inflatable such that inflation of the pontoons with gas raises the container and the water filling the container partially above the surface level of the larger body of water, wherein the pontoons are arranged in two groups attached on opposite sides of the container along a length of the container, each group of the pontoons having a length substantially equal to the length as the container and with end surfaces of the pontoons substantially in a same plane as end surfaces of the container, and wherein the pontoons are located below the bottom surface of the container.

9. An apparatus according to claim 8, wherein the container is formed of several pieces detachably connected to each other.

10. An apparatus according to claim 8, wherein the container has level side, top and end surfaces, and the at least one open opening covers substantially the entire bottom surface of the container.

11. An apparatus according to claim 8, wherein the container is formed of several pieces.

12. A method for lifting a mass of water, comprising:

with a container having i) attached pontoons, ii) an upper surface, and iii) a bottom surface with an opening, fully submerging the container, including the upper surface, entirely below a surface level of a body of water so that the water has access to an interior of the container through the opening and fills the interior of the fully submerged container, up to a lower side of the upper surface, with a mass of water; and adding gas to the pontoons to inflate the pontoons sufficient to raise the container with the interior filled with the mass of water partially above the surface level of the body of water such that the opening in the bottom surface of the container remains located below the surface level of the body of water during and after the raising of the container, wherein said raising of the container by inflating the pontoons lifts the mass of water located in the interior of the container above the surface level of the body of water.

13. The method of claim 12, wherein the opening of the container substantially covers a whole of the bottom surface of the container.

14. The method of claim 12, wherein the pontoons are arranged in two groups attached on opposite sides of the container along a length of the container, each group of the pontoons having a length substantially equal to the length as the container and with end surfaces of the pontoons substantially in a same plane as end surfaces of the container.

15. The method of claim 14, wherein the pontoons are located below the bottom surface of the container during the raising of the container.

16. The method of claim 12, wherein fully submerging and filling the container with the mass of water includes removing all air from the interior of the container.

* * * * *